US008926442B2

(12) United States Patent
Dubois

(10) Patent No.: US 8,926,442 B2
(45) Date of Patent: Jan. 6, 2015

(54) AUTOMATIC TEE AND GOLF BALL POSITIONER FOR GOLF COURSES

(76) Inventor: Gérard Dubois, Montgeron (FR)

( * ) Notice: Subject to any disclaimer, the term of this patent is extended or adjusted under 35 U.S.C. 154(b) by 0 days.

(21) Appl. No.: 13/882,762

(22) PCT Filed: Oct. 14, 2011

(86) PCT No.: PCT/FR2011/000551

§ 371 (c)(1),
(2), (4) Date: Jun. 17, 2013

(87) PCT Pub. No.: WO2012/062974

PCT Pub. Date: May 18, 2012

(65) Prior Publication Data

US 2013/0331194 A1 Dec. 12, 2013

(30) Foreign Application Priority Data

Nov. 12, 2010 (FR) ..... 10 04409

(51) Int. Cl.
*A63B 57/00* (2006.01)

(52) U.S. Cl.
CPC ..... *A63B 57/0006* (2013.01); *A63B 57/0037* (2013.01)
USPC ..... 473/132; 473/386; 473/137

(58) Field of Classification Search
USPC ..... 473/386, 132, 137; 294/19.2
See application file for complete search history.

(56) References Cited

U.S. PATENT DOCUMENTS 1,863,140 A 6/1932 Mulvaney
5,330,178 A * 7/1994 Geishert, Sr. ..... 473/386
5,499,813 A * 3/1996 Black ..... 473/386
5,624,333 A 4/1997 Dayton
6,053,821 A * 4/2000 Palmer ..... 473/386
6,203,452 B1 3/2001 Kelman et al.
6,338,685 B1 1/2002 Posluszny
2005/0255929 A1 11/2005 Naus

OTHER PUBLICATIONS

International Search Report, Nov. 30, 2011, from International Phase of the instant application.
English Translation of the Written Opinion of the International Search Authority, May 12, 2013, from International Phase of the instant application.
English Translation of International Preliminary Report on Patentabaility Chapter I, May 14, 2013, from International Phase of the instant application.

* cited by examiner

*Primary Examiner* — Steven Wong
(74) *Attorney, Agent, or Firm* — Jackson Patent Law Office

(57) ABSTRACT

The invention relates to a portable and ergonomic instrument for storing golf balls and tees and for automatically positioning a tee in the ground at a predetermined height and a ball in balance thereon, by means of a movement of one hand on the part of the player in the standing position. Said instrument consists primarily of a main body (10) serving as a storage unit (12) for balls (Bn), a multi-purpose shuttle (20) and a retaining clamp (P). After setting the desired height of the ball on the thumbwheel (50), the alternating movement of the shuttle (20) from abutment to abutment, using the knob (21), first upward, then downward and finally upward, enables the result to be achieved. Any golfer who has difficulty bending down or squatting, and those who do not wish to bend down or squat, may be interested in owning such an instrument.

9 Claims, 6 Drawing Sheets

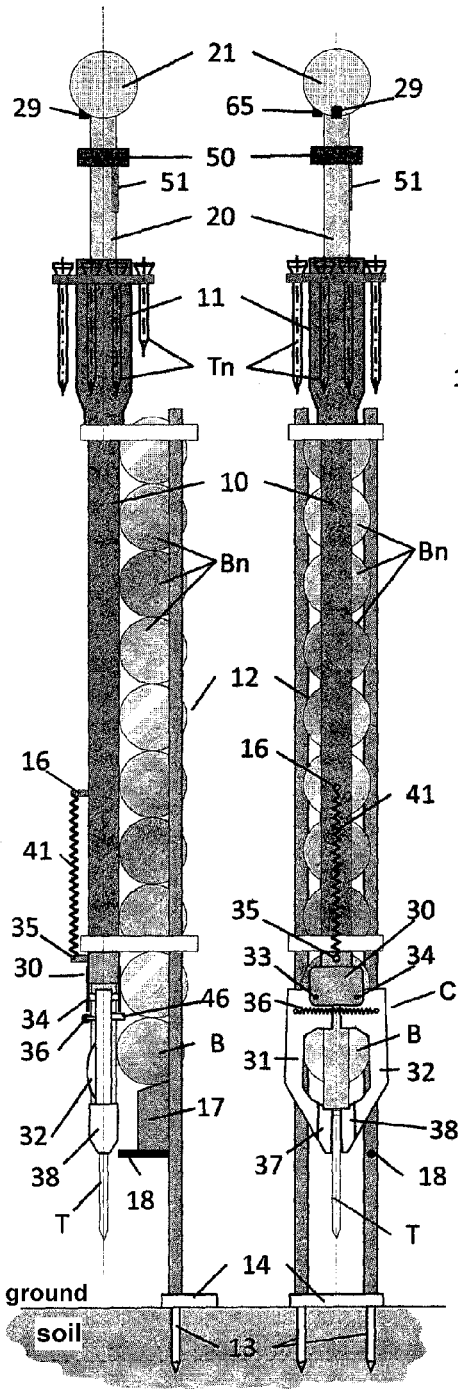
FIG.1
FIG.2
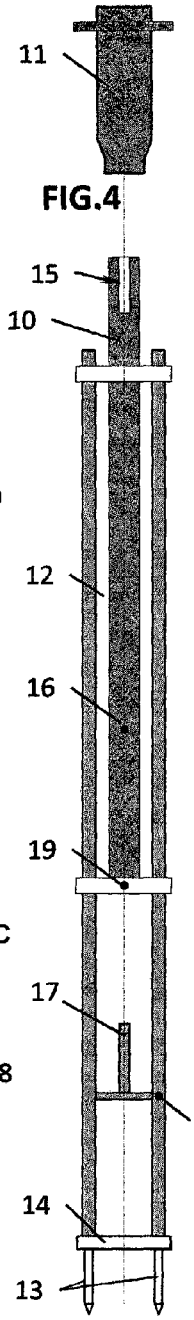
FIG.4
FIG.3
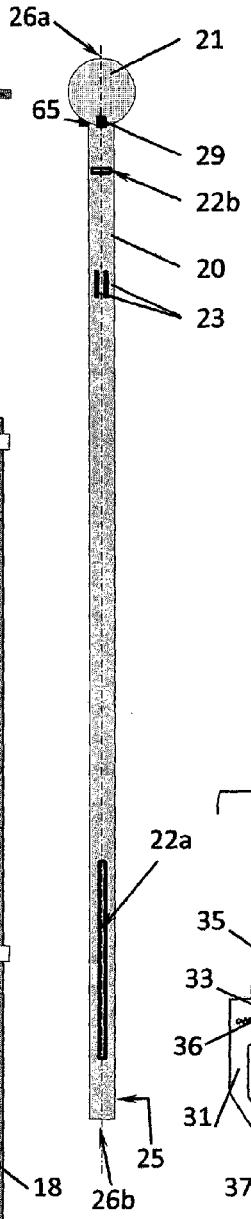
FIG.5
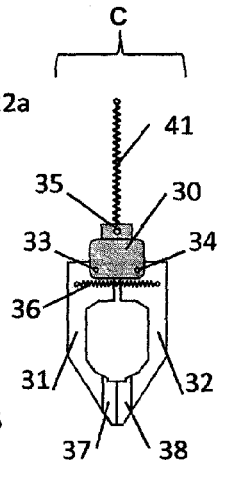
FIG.6 section DD
section CC
section BB
10
41
30
33
34
36
20
B
32
31
37
39
40
Tb
Ta
T
C
D
46
17
18
38
42
43
44
45 ground
soil
H
T
B

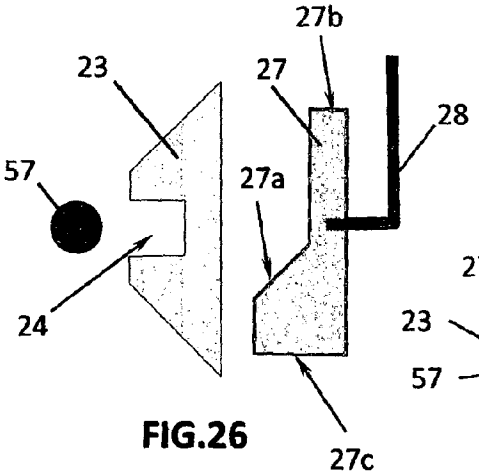
FIG.26
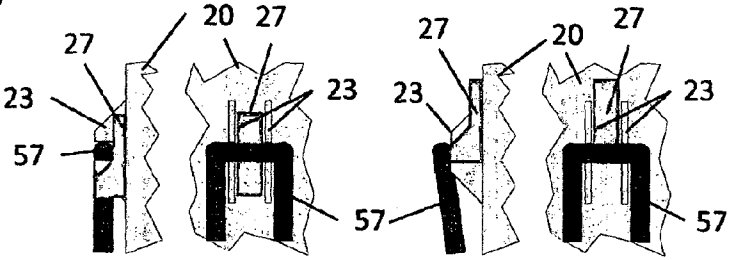
FIG.27
FIG.28
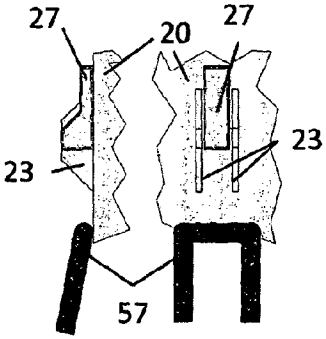
FIG.29
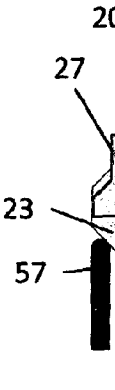
FIG.30
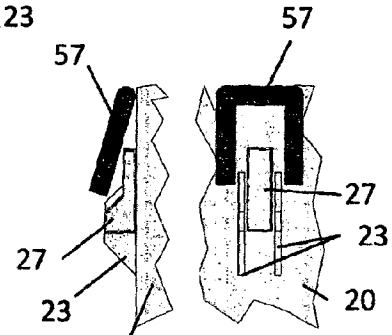
FIG.31
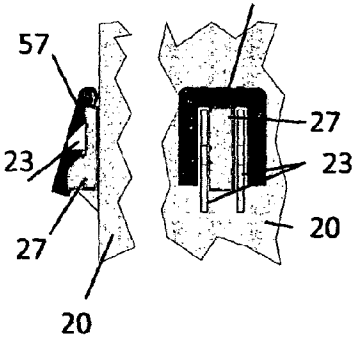
FIG.32
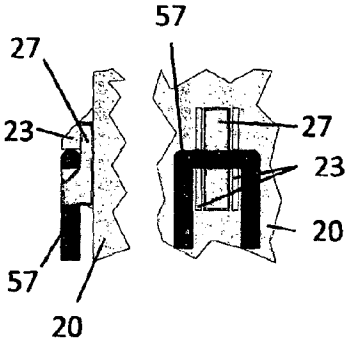
FIG.33

AUTOMATIC TEE AND GOLF BALL POSITIONER FOR GOLF COURSES

The present invention relates to a portable ergonomic instrument enabling a golfer to remain standing and use only one hand to drive a tee into the soil and position a golf ball balanced on it at a desired height, at each tee off on a golf course.

Traditionally, different tees and balls are available to the player in a bag or in his pockets. The tee is manually driven into the ground at an approximate height by the player who subsequentely, or at the same time, manually positions a ball balanced on the tee. This operation requires the player to bend or crouch. During this operation, the player holds a golf club in his other hand.

The object of the invention comprises providing a manually controlled device for driving a golf tee into soil and automatically delivering a golf ball on top of it, which can be handled with a single hand by the player standing without having to stoop or squat.

A second object of the invention comprises providing a device for driving a tee into soil and positionning a ball on it at an accurate height depending on the club that will be used.

Another object of the invention comprises providing a device for driving a tee into soil positioning a ball on it, that is practical, functional and compact.

The instrument according to the invention comprises the following features:

- the instrument is portable and can be stored in a golf club bag
- it is fitted with a tee storage unit that enables loading of the instrument with tees of different lengths for the entire course, before the start of the course. Thus the player does not need an additional bag or to use his pockets
- it is fitted with a ball storage unit that enables loading of the instrument with balls before departure and during the course. Thus the player does not need an additional bag or to use his pockets
- its use only requires one hand, which enables the player to hold his club in the other
- it is driven into soil and maintained upright without human intervention, which enables the player to perform the following operations: moving from his equipment parking place to the place of the swing, with the instrument in one hand, a club in the other; perform the operation of positioning of the tee and of the bal, driving the instrument into soil; performing his swing, grasping the instrument again and returning to his equipment
- the instrument has a length sufficient so that it can be handled to provide all the functions to achieve the expected result: ball on tee driven into soil at the correct height, by a player standing upright
- the instrument is designed so that all controls are accessible by the player with a single hand, the aforementioned hand being placed on the upper end of the instrument
- the instrument is driven into soil by the player standing upright, who holds it vertically with one hand and drives it into soil until a guard limits the stroke to provide an accurate position of the instrument height. He can make use of the tip of his foot by pushing on the guard
- the instrument enables positioning of each ball at the desired height, depending on the club used for the swing of the hole
- the instrument is fitted with a wheel accessible in upright position, which enables programming of the desired ball height

- it is also fitted with a shuttle tube that can handled with one hand by a player standing upright, which enables:
  - in a first phase, after the player has taken the desired tee in the tee storage unit and has introduced it into the upper orifice of the shuttle tube, to gravity feed the tee into a clamp located in the lower part of the instrument; at that time the clamp is slightly opened to enable the tee to be easily inserted into its jaws and to be retained by its head by two pins from one of the two jaws
  - in a second phase, after having released the shuttle using a finger and having displaced it upward, to automatically supply a golf ball into the clamp from the ball storage unit and come back to lock on the clamp
  - in a third phase, by a downward displacement, providing the displacement of the clamp containing the tee and the ball and the driving the tee into soil
  - in a fourth phase, triggering the opening of the clamp and its automatic ascent
  - in a fifth phase, after arriving at lower stop, providing accurate programmed ball height
  - in a sixth phase, after having reascended at initial stop, pulling the instrument out of the ground A variant of this technical solution comprises using a single type tee, for all ball heights to be obtained, which provides an automatic delivery of a tee from a tee storage unit, controlled by the player from the upper end of the instrument.

In summary, the various actions to be preformed by the player standing upright are: driving the instrument into the ground, taking a tee in the storage unit, inserting it into the upper orifice, or operating a feed button, activating a dial in order to set the desired ball height, pressing on a release button with a finger, lifting the shuttle tube until coming to upper stop, lowering the until coming to lower stop, relifting the shuttle tube until coming to intermediate stop, and continuing to lift it in order to pull the instrument out of the ground.

Theses features others of the invention will be apparent from the description that follows of a preferred implementation mode given by way of non-limiting example, making reference to the accompanying drawings in which:

FIG. 1 shows the right view of the instrument

FIG. 2 shows the front view of the instrument

FIG. 3 shows the front view of the main body

FIG. 4 shows the tee storage unit

FIG. 5 shows the tube-shuttle

FIG. 6 shows the retaining clamp

Figure 7:
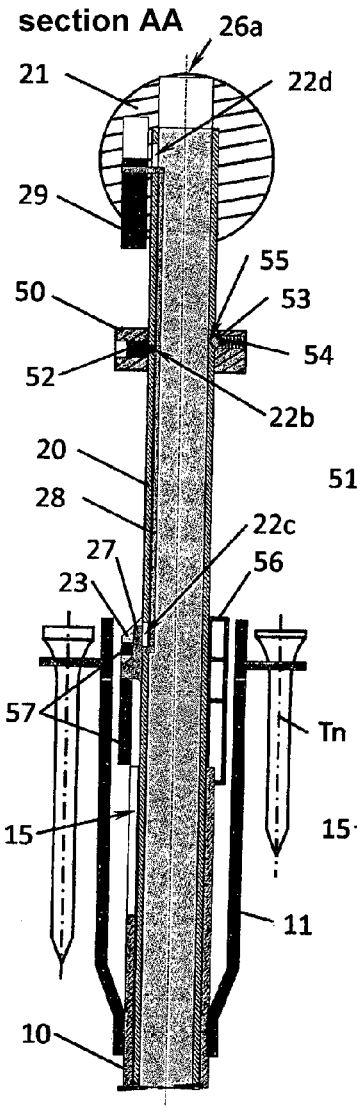
Figure 8:
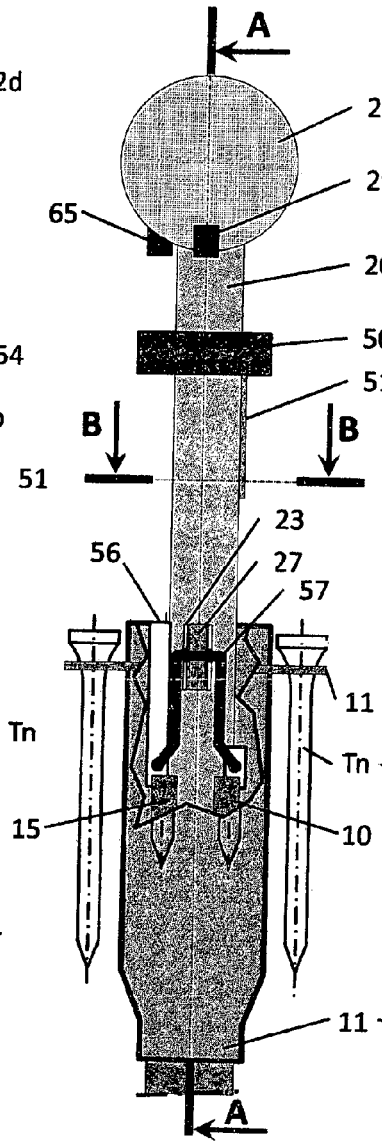
Figure 9:
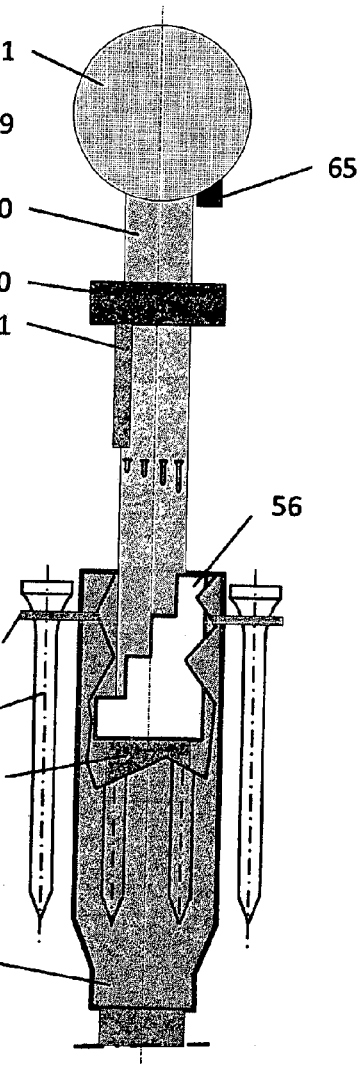
Figure 10:
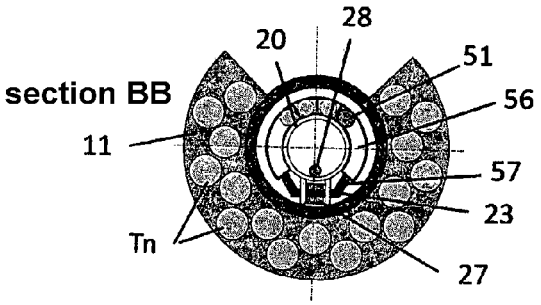
Figures 11, 12, 13, 14, 15:
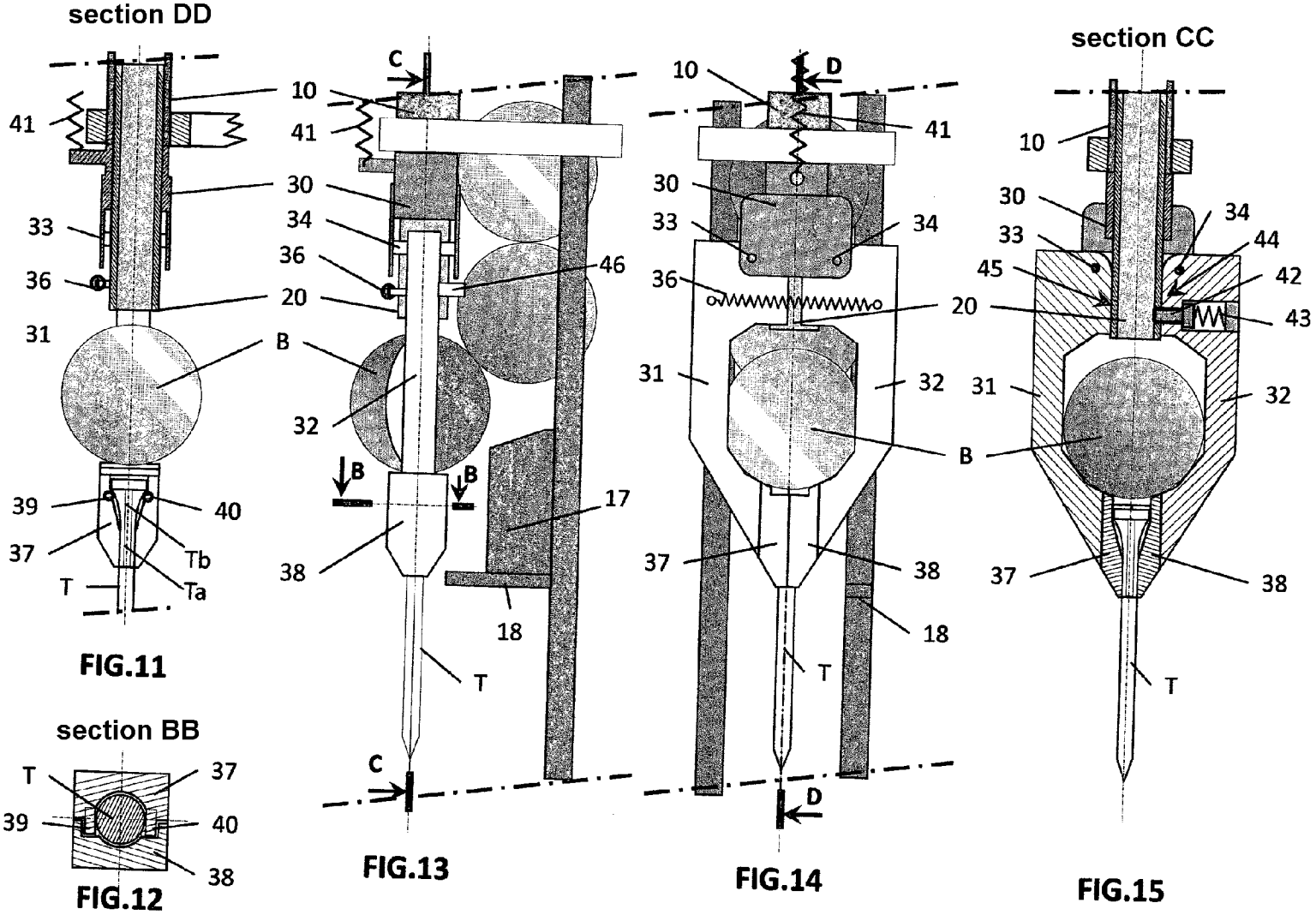
Figures 16, 17, 18, 19, 20, 21, 22, 23, 24, 25:
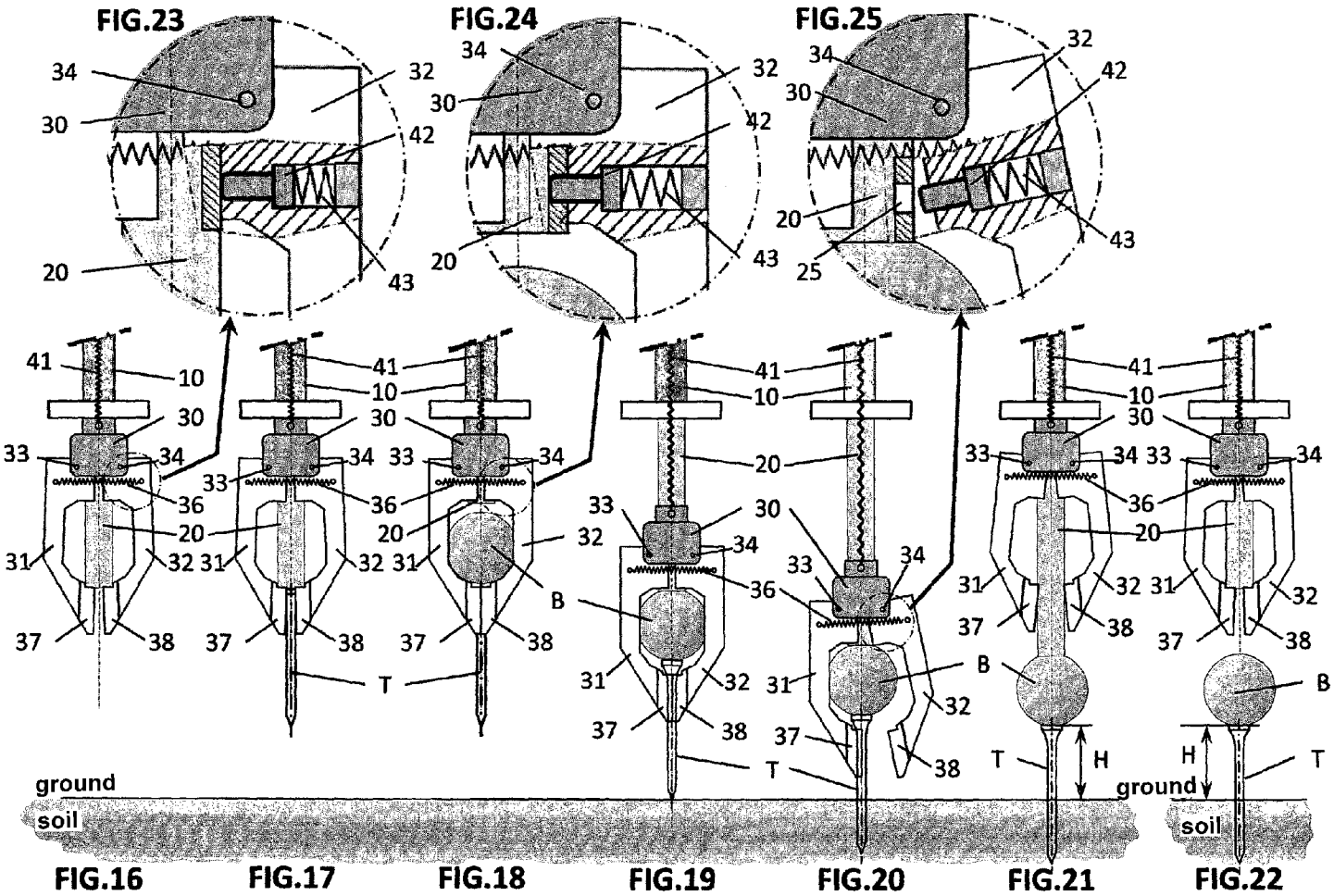
Figures 34, 36, 37:
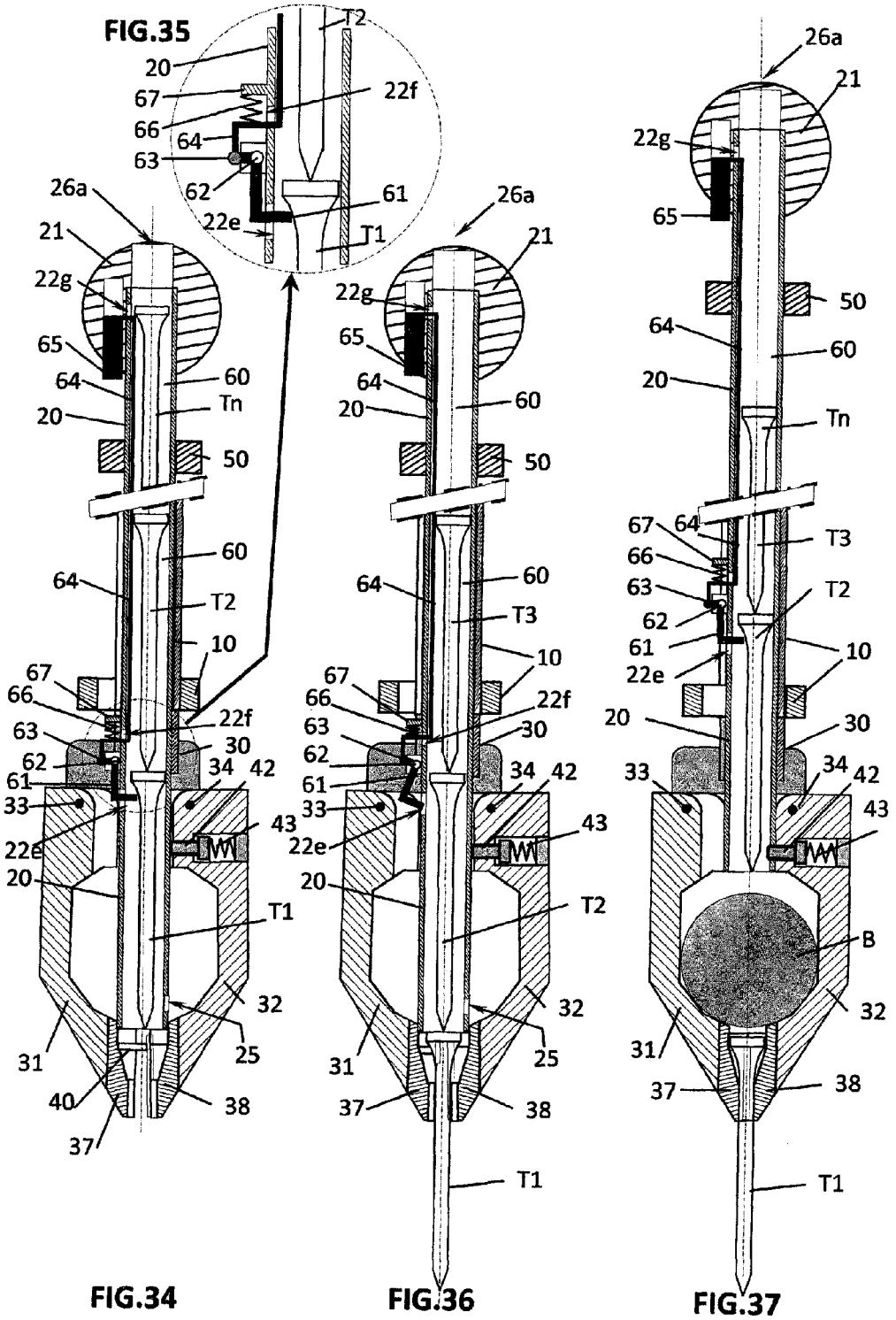

FIG. 7 shows a section of the right view of the upper part of the instrument FIG. 8 shows a front view with cutaway of the upper part of the instrument FIG. 9 shows a rear view with cutaway of the upper part of the instrument FIG. 10 shows a section of the top view FIG. 11 shows a partial right section of the lower right portion of the instrument at the clamp FIG. 12 shows a section top view of the jaws of the clamp FIG. 13 shows a partial right side view of the lower portion the instrument, at the clamp FIG. 14 shows a partial front view of the lower part of the instrument, at the clamp FIG. 15 shows a partial sectional front of the lower part of the instrument at the clamp FIGS. 16-25 represent the clamp, the shuttle the tee and the ball at each stage of the cycle FIG. 16 shows the rest position FIG. 17 shows a fed tee FIG. 18 shows a fed tee and a fed ball FIG. 19 shows the moment when the tee touches the ground FIG. 20 shows the moment of the opening of the clamp FIG. 21 shows the clamp returned into start position and the end of the phase of driving the tee into the soil FIG. 22 shows the end of the cycle with the return of the shuttle into start position and the result obtained: the ball balanced on the tee driven into the soil.

FIG. 23 shows a section at the bolt of the clamp arm on the shuttle in the rest position, the bolt is released FIG. 24 shows a section at the bolt of the clamp arm on the shuttle in upper feed position of the ball, the bolt is latched FIG. 25 shows a section at the bolt of the clamp arm on the shuttle during the opening of the clamp arm; it is the phase of releasing of the bolt FIGS. 26-33 show the principle of the system of locking/releasing of the shuttle, at different stages of the cycle FIG. 26 shows the sections of the bolt, of the strike plate and of the release gib FIG. 27 shows the system locked FIG. 28 shows the release phase with the displacement of the gib FIG. 29 shows the ball feed phase FIG. 30 shows the phase of driving of the tee into soil, with passage of the bolt without locking FIG. 31 shows the end of the driving phase FIG. 32 shows the pre-phase of locking with automatic displacement of the gib in order to enable locking FIG. 33 shows the system locked FIGS. 34-37 show partial sections of the front view, with the option of automatic feeding of the tees, at different stages of the cycle With reference to these drawings, the instrument is constituted principally by: a main body, a shuttle, a holding clamp, a system for height adjustment of the ball height and a release/lock system for start and end of cycle. The instrument operates in vertical position.

The reference position used in the description below will be the operating position; that is to say the vertical device, driven into the ground up to the level of the stop (14).

The main body is constitued by a sleeve (10), a tee storage unit (11), a golf ball (Bn) storage unit (12), two prongs (13) enabling the apparatus to hold itself vertical once driven into the ground and a better stability about the vertical axis, a stop (14) that enables correct positioning of the apparatus, a fixed gib (17) that closes the ball storage unit (12) and guides the ball (B) during the positioning cycle.

A stop pin (18) of the body (10) will control the opening of the clamp.

A lug (19) of the body (10) will provide the anti-rotation and the ends of stroke of the shuttle (20).

The tube-shaped shuttle slides in the sleeve (10) along its axis longitudinal. It enables the supply of a tee in its center, the supply of the ball (B) and driving of the tee (T) into the ground, at the desired height (H) with the ball balanced on it.

It is composed of a tube (20) and a knob (21) for manual gripping.

A lumen (22*a*) receives a lug (19) fixed to the body (10), to provide the anti-rotation and to limit the stroke of the shuttle (20) relative to the body (10).

Two planes (23) parallel to the longitudinal axis, of trapezoidal shape, in which are formed recesses (24), form a stike plate that will receive the locking wire (57).

A hole (25) acting as a strike plate enables the locking of the retaining clamp (C).

The interior of the shuttle (20) can be used as a tee (Tn) storage unit (60) for the automatic feeding of the tee (T), whose unitary output is brought about by exerting a force on the control button (65), located in the knob (21), actuated with with one finger of the hand, the hand on the knob, and connected to a rod (64), itself connected by the hinge (63) to a retaining tab (61), itself movable in rotation about the axis (62) of the shuttle (20) which causes the pivoting of the tab (61) thereby releasing the column of tees that will be stopped in its stroke under the effect of gravity when the first tee is retained by the jaws (37) and (38) of the clamp (C). A spring (66) provides the return of the tab (61) into start position of the closed storage unit.

The holding clamp (C) enables holding of the tee (T) and the ball (B) during a part of the operation.

The holding clamp (C) is slidable on the shuttle (20). It is constuted by a slide (30) and two arms (31) and (32).

The arms (31) and (32) are hinged relative to the slide about the axes (33) and (34).

A stud (35) fixed to the slide (30), travels through the lumen (22*a*) of the shuttle (20) to provide the anti-rotation of the clamp relative to the shuttle (20).

A spring (36) connects the two arms (31) and (32) and provides the closure of the clamp.

The arms (31) and (32) have special shapes: the jaws (37) and (38) for holding the tee (T) in vertical position and their central part (31) and (32) for holding the ball once fed.

Resting, the retaining claimp is in vertical abutment on the body (10) returned by a spring (41) fixed to the body (10) by the hook (16).

In rest position or cycle start position, the shuttle (20) is locked relative to the main body (10).

In this rest position, the clamp is slightly ajar due to the presence of the end of the shuttle (20) between the jaws (37) and (38), which enables the tee (T) to easily slide in the jaws (37) and (38), at the moment of its supply.

The operation begins at this position, by the choice of the ball height (H) suitable for the club used.

The tee to be used is taken from the storage unit (11) and manually inserted into the upper port (26*a*) of the shuttle (20) if one opts for use with the tee usage of different length, depending on ball heights (H). It discharges under gravity from the lower port (26*b*) of the shuttle (20) and inserts itself between the open jaws (37) and (38) of the holding clamp, which centers it and retains it by its head, in vertical position, using the pins (39) and (40) of the jaw (37).

Alternatively, with use of tees having identical length, activation of the pushbutton (65) enables the feeding the supply of a tee (T) between the jaws (37) and (38).

The ball height (H) adjustment system is located just below the knob (21) and accessible the hand resting thereon.

It is composed of a wheel (50) fitted with an attached finger (51).

A screw pin (52) of the wheel (50) moves through a lumen (22*b*) providing the maintenance of the wheel (50) along the longitudinal axis of the shuttle (20) and the limitation of its rotation.

The wheel (50) is locked in rotation according to different preferred positions, via a ball lock. A ball (53) under the force of a spring (54) arranged radially in the wheel (50) lodges itself in cavities (55) of the shuttle (20).

Each position corresponds to a desired height of the ball.

The ball height (H) is provided by the stroke of the shuttle.

The final desired ball height (H) is obtained by way of the lower stroke limit of the shuttle (20).

The lower stroke limit is implemented by a stepped stopper (56) fixed in the upper part of the body (10) on which the finger (51) comes into contact. Each step corresponds to a particular ball height (H).

The system of releasing/locking of the beginning and end of the cycle is implemented by the planes (23) of the shuttle (20), a spring wire (57) fixed to the stepped stopper (56), itself fixed on the main body (10), a mobile releasing gib (27), an unlocking rod (28) and a knob (29). The rod is located in the interior of the tube-shuttle (20), that it passes through it at the ports (22*c*) and (22*d*).

In the locking position, the spring wire (57) is in the recesses (24) of the planes (23). The spring wire (57) biases to come into contact with the shuttle (20).

The releasing occurs responsive to a pressure on the button (29), which via the rod (28) moves the releasing gib (27), which due to its sloped wedge shape, releases the spring wire (57) from recesses (24).

The locking is possible when the gib (27) returns back to the start position. The latter is automatically found during the ascent of the shuttle, when the part (27*b*) of the gib (27) comes into contact with the spring wire (57). Thus the spring wire (57) pushes the gib and engages in the ramp of the planes (23), in order to come to lock into the recesses (24).

At the descent of the shuttle (20), the locking cannot occur because, conversly, the contact of the spring wire (57) with the part (27*c*) of the gib (27) causes its displacement, into a position that masks the recesses (24) of the planes (23).

The operation of the instrument is manifested in this manner:

The release of the bolt (57) by pressing on the button (29) enables the displacement of the shuttle (20) by exerting an upward force.

At the start of the displacement, the shuttle (20) is released from the jaws (37) and (38) of the clamp, which under the action of the spring (36), will clamp the cylindrical part (Ta) of the rod of the tee (T).

The parallel pins (39) and (40) enable maintenance of the elevation of the tee (T), despite the tapered shape of its rod at the top (Tb), from its feeding until complete closure of the clamp. Thus the jaws (37) and (38) of the clamp will grip only the lower cylindrical portion (Ta) of the rod of the tee (T).

Arrived in upper position, the shuttle (20) releases the opening of the ball storage unit (12), which enables a ball (B) to go into the arms (31) and (32) of the clamp (C) in upper position above the tee (T). It is guided by the oblique side gib (17) and stopped by the arms (31) and (32) having adapted shape. The following balls (Bn) are accumulated.

The first ball being in the clamp. The second is in contact with it. It will remain there until the shuttle (20) closes the opening of the storage unit (12) and becomes abutted to the column of balls (Bn), thus playing the role of discharge.

At this same position the shuttle (20) releases a bolt (42) located in the arm (32) of the clamp, which penetrates into the hole (25) of the shuttle (20) under the action of the spring (43). The clamp and the shuttle are now locked.

The stability of the clamp is provided by the cylindrical shape of the upper parts (44) and (45) of the arms (31) and (32), which surround the shuttle (20).

By exerting a force downward on the knob (21) of the shuttle (20), to overcome the reaction of the spring (41), the assembly (of the shuttle, holding clamp, ball and tee) desends. The ball (B) is continuously guided by the gib (17) which contains it in the clamp (C).

The tee (T) comes into contact with the ground (ground) at the top, then, by reaction of the ground on the tee (T), comes into contact with the ball (B) in the upper part, and successively by continuing the displacement of the shuttle (20), the ball (B) comes into contact with the shuttle (20).

Due to a force still exerted on the knob (21) but with higher intensity, the shuttle-ball-tee-clamp assembly (B, T, C) continues its stroke by driving the tee (T) into the soil After a few millimeters of penetration of the tee (T) into the ground, a tab (46) of the clamp arm (32), which supports the bolt (42), comes into contact with the stop (18) located on the main body (10). The downward vertical stroke of the shuttle (20) causes the opening of the clamp arm (32), which releases the bolt (42) from the strike plate hole (25) of the shuttle (20).

Thus the released clamp (C), biased by its spring (41), ascends. At the passage of the ball (B) it opens under the reactive effect exerted by the ball (B) on the clamp arms (31) and (32) by overcoming the reaction of the clamp-closing spring (36).

Arrived in upper start position, the jaws (37) and (38) come to grip the shuttle (20) which passes through the clamp (C), under the effect of the spring (36).

The tee-ball assembly (T, B) remains stable during this phase of driving into the soil, because it is caught between the opposing forces exerted by the thrust of the shuttle (20) on the ball (B) and the reaction of the soil on the tee (T), and the annular sections of the tee (T) ball (B) and ball (B) shuttle (20) interfaces.

The stroke is terminated when the finger (51) comes into contact with the stepped stopper (56).

From this position, by exerting a force upwards on the knob (21) of the shuttle (20), the latter goes back up until the spring wire (57) lodges in the strike plate recesses (24) and stops its ascending stroke at its start height of the cycle. In this position the clamp (C) is closed at its start position. The cycle is terminated. The ball (B) is balanced on the tee (T) driven into the soil at the selected height (H). The expected result is obtained.

The device can be pulled out of the soil by continuing the upward force on the knob (21) and stuck further away by the player who now has both hands available to perform his swing.

All golfers who have difficulty stooping or squatting, and those who do not wish to stoop or squat, may be interested in having such an instrument.

The invention claimed is:

1. An ergonomic and portable automatic positioner, for golf tees (ball support for a swing) and golf balls balanced on the tees at a programmable height, for golf courses, the positioner comprising:

storage units for the tees;

a storage unit for the golf balls;

a main body comprising two prongs, that, once driven into the ground, provide retention of the main body in a vertical position and holding of the main body against rotation about a longitudinal axis of the main body;

a guard, that provides a height position reference, for operation of the positioner;

a shuttle topped with a knob enabling a player to perform all necessary operations to achieve a ball balanced on a tee driven into the ground at the desired height, with a single hand, standing, body not bent, the hand on the knob, from driving of the positioner into the ground, to removal of the positioner at end of the operation;

a device for programming and setting of the ball height desired;

a holding clamp for the tee and for the ball with automatic opening, closing and vertical return stroke, wherein the holding clamp is slidably on the shuttle which traverses the holding clamp along a longitudinal axis of the holding clamp; and a port, located at an upper end part of the positioner, in order to effect the supply of tees into the storage unit, wherein the positioner has a length sufficient so that the positioner can be handled by the player standing without the player having to bend or crouch, and all controls are accessible by the player with a single hand, the hand being placed on the upper end of the positioner, whereby the positioner provides automatic delivery of the tee and the ball from the storage units and provides the ball balanced on the tee at a given height, by mere displacements of the shuttle, upwards on a first stop, and then downwards on a second stop and upwards on a third stop in rest position.

2. An automatic positioner for tee and golf ball, for golf courses, according to claim 1, characterized in that that all displacements of the clamp and the movements of arms and of the clamp are automatic.

3. An ergonomic and portable automatic positioner, for golf tees (ball support for a swing) and golf balls balanced on the tees at a programmable height, for golf courses, the positioner comprising:

storage units for the tees;

a storage unit for the golf balls;

a main body comprising two prongs, that, once driven into the ground, provide retention of the main body in a vertical position and holding of the main body against rotation about a longitudinal axis of the main body;

a guard, that provides a height position reference, for operation of the positioner;

a shuttle topped with a knob enabling a player to perform all necessary operations to achieve a ball balanced on a tee driven into the ground at the desired height, with a single hand, standing, body not bent, the hand on the knob, from driving of the positioner into the ground, to removal of the positioner at end of the operation;

a device for programming and setting of the ball height desired;

a holding clamp for the tee and for the ball with automatic opening, closing and vertical return stroke; and a port, located at an upper end part of the positioner, in order to effect the supply of tees into the storage unit, wherein the positioner has a length sufficient so that the positioner can be handled by the player standing without the player having to bend or crouch, and all controls are accessible by the player with a single hand, the hand being placed on the upper end of the positioner, whereby the positioner provides automatic delivery of the tee and the ball from the storage units and provides the ball balanced on the tee at a given height, by mere displacements of the shuttle, upwards on a first stop, and then downwards on a second stop and upwards on a third stop in rest position, the positioner further including a system of releasing/locking, for cycle start and end in rest position, of the shuttle relative to the main body, implemented by a strike plate of the shuttle, a spring wire bolt attached to the main body, a mobile releasing gib attached to a release rod adjoining to a control button located in the knob, the releasing being thereby effected a finger, the hand on the knob and the locking being thereby automatic; and in that the gib prevents the locking of the shuttle at the height of the rest position in downward displacement of the shuttle from the first stop to the second stop.

4. An automatic positioner for tee and golf ball, for golf courses, according to claim 1, further including a tee storage unit, located in the shuttle, the unit output of the tees is controlled by applying a pressing on a control button located in the knob, actuated with a finger of the hand, the hand positioned on the knob, that is connected by a system suitable for a retaining tab located in the lower part of the shuttle blocking the downward displacement of the storage column of tees.

5. An automatic positioner for tee and golf ball, for golf courses, according to claim 1, characterized in that, during supply of the tee by the shuttle in rest position, in the clamp, the shuttle partially opens the clamp to facilitate insertion of the rod of the into the jaws of the clamp.

6. An automatic positioner for tee and golf ball, for golf courses, according to claim 1, characterized in that a jaw of an arm of the clamp comprises two retaining pins for the tee head of the tee, that will maintain the tee aloft during the closing of the clamp under the action of the closing spring, during disengagement of the shuttle and will enable the definitive closing of the clamp in order to provide the clamping of only the cylindrical part of the tee, by the jaws, using the tapered shape of the upper part of the tee.

7. An automatic positioner for tee and golf ball, for golf courses, according to claim 1, characterized in that the clamp, that holds the tee and the ball, comprises a bolt biased by a spring, located in one of the arms of the clamp, the aforementioned bolt enables automatic locking of the displacement of the clamp relative to the shuttle.

8. An automatic positioner for tee and golf ball, for golf courses, according to claim 1, characterized in that the shuttle provides the closing of the ball storage unit.

9. An ergonomic and portable automatic positioner, for golf tees (ball support for a swing) and golf balls balanced on the tees at a programmable height, for golf courses, the positioner comprising:

storage units for the tees;

a storage unit for the golf balls;

a main body comprising two prongs, that, once driven into the ground, provide retention of the main body in a vertical position and holding of the main body against rotation about a longitudinal axis of the main body;

a guard, that provides a height position reference, for operation of the positioner;

a shuttle topped with a knob enabling a player to perform all necessary operations to achieve a ball balanced on a tee driven into the ground at the desired height, with a single hand, standing, body not bent, the hand on the knob, from driving of the positioner into the ground, to removal of the positioner at end of the operation;

a device for programming and setting of the ball height desired;

a holding clamp for the tee and for the ball with automatic opening, closing and vertical return stroke; and a port, located at an upper end part of the positioner, in order to effect the supply of tees into the storage unit, wherein the positioner has a length sufficient so that the positioner can be handled by the player standing without the player having to bend or crouch, and all controls are accessible by the player with a single hand, the hand being placed on the upper end of the positioner, whereby the positioner provides automatic delivery of the tee and the ball from the storage units and provides the ball balanced on the tee at a given height, by mere displacements of the shuttle, upwards on a first stop, and then downwards on a second stop and upwards on a third stop in rest position, the positioner further including a system for selecting a ball height to be obtained, actionable by the operator holding the knob, composed of a control wheel that can be locked in position relative to the shuttle by a bolt with a spring in strike plates of the shuttle, a vertical finger adjacent the handwheel, and a stepped stop, of which each stage corresponds to a ball height to be complied with depending on the type of club used for the cut, on which the finger comes into abutment, limiting the stroke of the shuttle, thereby providing the accurate height previously selected of the ball on assembly.

* * * * *